US005336121A

United States Patent [19]

Baret

[11] Patent Number: 5,336,121

[45] Date of Patent: Aug. 9, 1994

[54] ELECTRICALLY INSULATING ELEMENTS FOR PLASMA PANELS AND METHOD FOR PRODUCING SUCH ELEMENTS

[75] Inventor: Guy Baret, Eybens, France

[73] Assignee: Thomson Tubes Electroniques, Velizy, France

[21] Appl. No.: 969,222

[22] PCT Filed: Jun. 19, 1992

[86] PCT No.: PCT/FR92/00561

§ 371 Date: Feb. 12, 1993

§ 102(e) Date: Feb. 12, 1993

[87] PCT Pub. No.: WO93/00698

PCT Pub. Date: Jan. 7, 1993

[30] Foreign Application Priority Data

Jun. 27, 1991 [FR] France ..... 91 08004

[51] Int. Cl.[5] ..... H01J 9/00; H01J 1/90

[52] U.S. Cl. ..... 445/25; 313/586; 445/58

[58] Field of Search ..... 445/24, 25, 58; 313/586, 518

[56] References Cited

U.S. PATENT DOCUMENTS

| | | | |
|---|---|---|---|
| 3,931,436 | 1/1976 | Kupsky | 313/518 X |
| 3,953,756 | 4/1976 | Monfroy et al. | 313/586 |
| 4,803,402 | 2/1989 | Raber et al. | 313/586 |
| 5,011,391 | 4/1991 | Kawasaki | 445/24 |
| 5,209,688 | 5/1993 | Nishigaki et al. | 445/24 |

*Primary Examiner*—Kenneth J. Ramsey

*Attorney, Agent, or Firm*—Oblon, Spivak, McClelland, Maier & Neustadt

[57] ABSTRACT

The invention relates to display screens of the plasma panel type. Its subject is more particularly electrically insulating elements such as spacers (12, 15) and/or dielectric layers (4, 6).

According to the invention, the spacers (12, 15) and/or the dielectric layers (4, 6) are produced from a polymerizable organic compound.

It results therefrom that the highest temperature imposed on the plasma panel during its manufacture can remain lower than a temperature of the sealing of this panel.

19 Claims, 1 Drawing Sheet

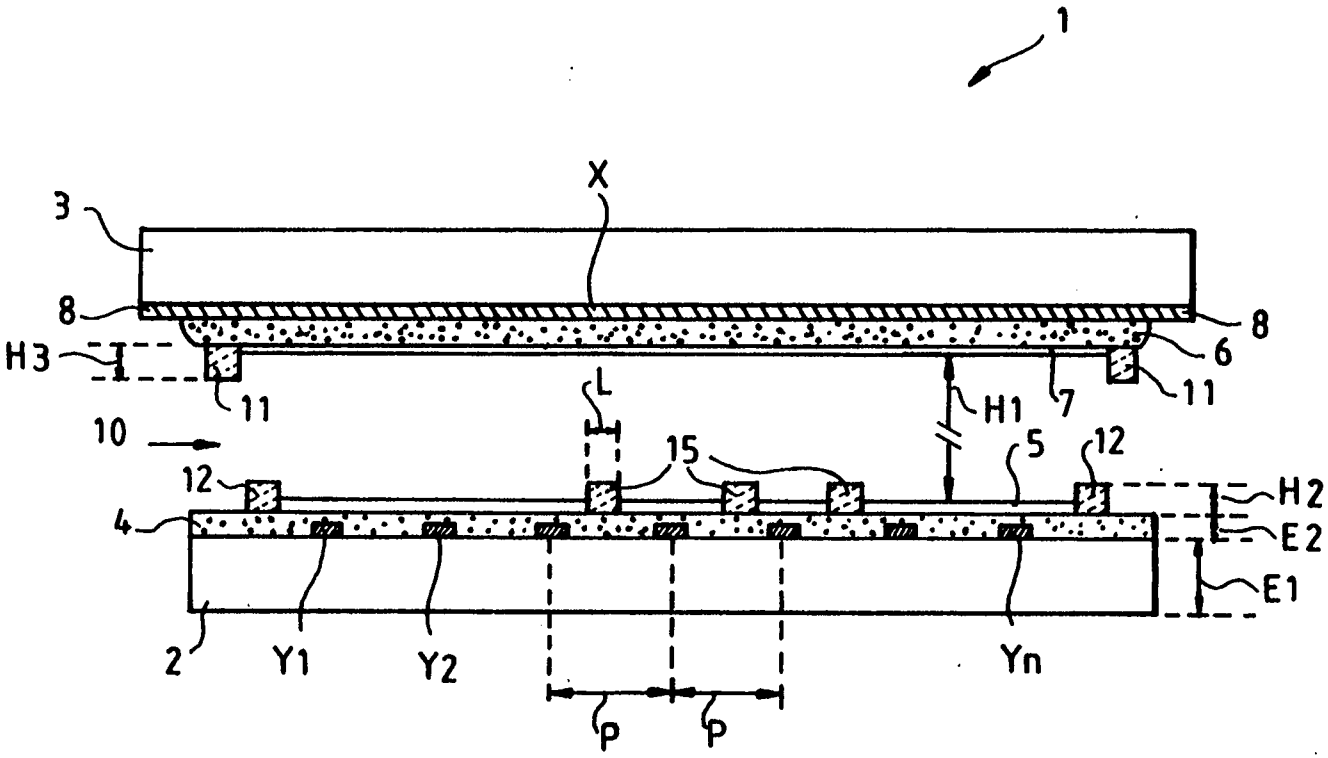
1
3
8
X
8
6
11
7
H1
H3
11
10
12
5
15
L
12
4
H2
E2
E1
Yn
Y2
Y1
2
p
p

ELECTRICALLY INSULATING ELEMENTS FOR PLASMA PANELS AND METHOD FOR PRODUCING SUCH ELEMENTS

The invention relates to display screens of the plasma panels type, and more particularly electrically insulating elements used in these devices.

Plasma panels (abbreviated to "PP") are flat display screens which operate according to the principle of luminescent discharges in a gas. They comprise two insulating plates assembled together so as to define between them a calibrated space. This space is closed in a leaktight manner at the periphery of the plates in order to form a gaseous space.

The electrical discharges in the gas are obtained using electrodes to which electrical voltages are applied. The electrodes may be distributed on either side of the gaseous space: in this the most common case, a network of electrodes is carried by one plate and at least one other network of electrodes is carried by the other plate. The two networks are orthogonal with respect to each other, and one elementary cell or pixel is defined at each intersection of electrodes. But the electrodes may also be disposed on the same side with respect to the gaseous space, that is to say be carried by the same plate.

Various types of plasma panels exist, in particular panels of the type operating with continuous voltage and the so-called "alternating" panels. The alternating panels have the advantage of having a memory effect which allows useful information to be addressed only to the pixels whose state (lit or extinguished) it is desired to change; on the other pixels, the state of the latter is simply maintained by repetition of alternate electrical discharges, called maintaining discharges. This memory effect is obtained by electrically insulating the electrodes from the discharge gas, covering them with a dielectric layer on which the charged particles generated by the discharge in the gas accumulate.

An explanation of the operation of an alternating-type panel is found in an article by G. W. Dick published in PROCEEDING OF THE SID, volume 27/3 1986, pages 183–187. The structure described in this document more particularly relates to a structure of the type with coplanar maintenance. Three electrodes are used in this type of panel in order to define a pixel: two parallel and coplanar electrodes produce the maintaining discharges in each pixel; the coplanar electrodes intersect with so-called addressing electrodes, whose operation is generally solely to produce the addressing in cooperation with one of the coplanar electrodes. It is to be noted that the abovementioned document furthermore mentions the use of discharge barriers whose function is to separate the discharges produced in contiguous cells.

Such discharge barriers may also be used in "PPs" whose cells or pixels are formed at the intersection of only two electrodes, and their presence is practically indispensable in "PPs" of the "continuous" type.

Whatever the type of "PP", the discharge barriers may consist of pieces forming thickness wedges, called spacers, which define the height of the gaseous space.

The function of such spacers is illustrated by the figure which shows a plasma panel of the type with two electrodes which intersect in order to define a cell or pixel. The figure is a sectional view parallel to one of these two electrodes.

The panel 1 comprises two plates 2, 3 each carrying a network of electrodes. The plates 2, 3 constitute substrates, they normally have a thickness E1 of the order of 1 to 6 mm.

The first plate 2 carries a first network of parallel electrodes Y1 to Yn. The second plate 3 carries a second network of parallel electrodes represented by an electrode X (represented parallel to the plane of the figure) orthogonal to the electrodes Y1 to Yn.

On the first plate 2, the electrodes Y1 to Yn (seen in their cross section) are covered with a dielectric layer 4, whose thickness E2 is usually of the order of 20 to 30 microns.

The dielectric layer 4 is covered with a protective layer 5 often of MgO whose thickness is very small, of the order of 0.2 microns.

On the second plate 3, the electrodes X of the second network are covered by a second dielectric layer 6 having substantially a thickness E2 the same as the first. This second dielectric layer is itself covered with a second protective layer 7 similar to the first 5. On the second plate 3, ends 8 of the electrode X, not covered by the dielectric layer 6, constitute contact points.

The two plates 2, 3 are intended to be assembled so as to create a space 10 between them which is to contain a gas, for example neon, at a pressure of for example 500 mb.

For this purpose, the panel 1 comprises seals 11 disposed at the periphery of one of the plates, the second plate 3 for example. The height H1 of the gaseous space 10 is defined using struts 12, called spacers, disposed at the periphery of one plate, of the first plate 2 for example. In the example represented, the spacers 12 are produced on the first dielectric layer 4, and when these two plates 2, 3 are brought together, these spacers must abut against the second protective layer 7; these conditions are taken into account in order to define the height H2 of these spacers 12 with a view to giving the gaseous space the desired height H1, which height H1 (of the gaseous space) is usually of the order of 100 microns.

The seals 11 generally consist of a glass with a low melting point (between 380° C. and 450° C). They comprise a height H3 such that, taking into account the surface on which they are disposed (surface of the second dielectric layer in the example), it is necessary to squash them in order to bring the spacers 12 into abutment on the second plate 3, so as thus to ensure leaktightness of the gaseous space 10.

The quality of operation of the "PP" may be degraded if the height H1 of the gaseous space exhibits variations which are too great. In order to avoid this defect, it is known to dispose, between the peripheral spacers or separators 12 and up to central positions, second struts 15 or central spacers having a thickness H2 the same as the first peripheral spacers 12.

It is also possible to use Such central spacers 15 in order furthermore to produce a separating barrier function between the discharges of contiguous pixels.

Each pixel being defined in the zone of intersection of electrodes X and Y, it is known to produce such central spacers 15 with a parallelepipedal form for example and to dispose them so as to surround each pixel.

These spacers then fulfill both a spacer function and a function of a barrier separating the discharges.

This technique is currently used, although it has the drawback of requiring time-consuming and difficult implementation. In fact, the separators or barriers 12, 15 are generally made of inorganic glass: walls of inorganic glass are formed in several intermediate layers by successive silk-screen printings. These successive silk-screen printings are followed by final baking in order to compact and harden the material. The layers produced by successive silk-screen printings are difficult to superimpose with precision: thus for a layer whose width is for example 50 microns, it is not uncommon for it to extend for 10 microns beyond the preceding layer, so that these partitions or barriers finally have variable widths, whose dimensions are difficult to control. A degradation of the operation of the plasma panel furthermore results therefrom.

Another drawback of this technique is that during the final baking of the layers forming these spacers or barriers, the temperature may reach, for example, 530° C. to 600° C. A degradation of the glass which forms the plates 2, 3 and/or a degradation of the conducting deposits which forth the electrodes may result therefrom. For example, the glass softens and loses its flatness if it does not rest on a support which is itself perfectly flat.

Another method for producing spacers (which in this case do not in addition fulfill the function of a discharge barrier) consists in depositing a dense network of graded glass balls, regularly disposed between the electrodes. But the precision relating to the diameter of the balls is not sufficient for most of the balls to be in contact at the same time with the two plates or substrates.

For plasma panels of the type operating with direct current, the general structure shown in the figure is the same, the difference being that in this case the dielectric layers 4, 6 and the protective layers 5, 7 do not exist, so that the electrodes X, Y1 to Yn are in contact with the gas contained in the gaseous space 10.

In "PPs" of the "alternating" type, the production of the dielectric layers also presents problems. In fact, all the dielectric layers of "alternating" type "PP" are currently made of inorganic glass with a low melting point (530 °C. to 600° C.), for example lead oxide glasses. These dielectrics made of glasses may be transparent, white, black or colored and have relative dielectric constants Er compatible with the operation of the alternating panels (Er typically between 10 and 30). The dielectric layers are made up in the following manner:

- a finely ground glass powder is mixed with a solvent or an oil which decomposes at temperatures greater than 400° C.;
- the mixture is then deposited by silk-screen printing, or by immersion or by spraying, then dried on the substrate or glass plate and the electrodes;
- the glass plate is then heated to temperatures greater than 530° C., and the mixture reacts in order to form a vitreous layer whose thickness is generally between 20 microns and 30 microns.

During this last treatment, a drawback resides in the fact that the glass plate must rest on an accurately machined plate, for example made of a ceramic, in order not to deform by virtue of the fact that the glass-transition temperature of the glass forming the substrate or plane close to 510° C.–520° C.

Furthermore, an these temperatures, the glass starts to react with the conducting or dielectric layers deposited on its surface, and in particular with the materials constituting the electrodes.

Conversely, this vitreous dielectric presents the advantage of very high mechanical and chemical stability, during the subsequent step of sealing the plasma panel, which step requires temperatures of at least 400° C.

With a view to addressing the various problems mentioned above, presented by the electrically insulating elements such as dielectric layers and spacers and/or discharge barriers for plasma panels, the invention proposes producing these elements from materials whose use does not require the exposure of the whole of the plasma panel to a temperature much greater than that which is necessary in the sealing step.

For this purpose, the invention proposes producing at least one of the electrically insulating elements mentioned above from a polymerizable organic compound which is thermally stable for temperatures equal to or less than the temperature of sealing of the plasma panel in which it is mounted.

The advantage which results therefrom is that the highest temperature imposed on the plasma panel is that necessary to produce the sealing.

Furthermore, in particular in the case of the spacers and/or the discharge barriers, the organic compound used may be photosensitive, which makes it possible to etch it in a simple manner by conventional photolithographic etching methods, and to obtain any type of pattern with excellent resolution and uniform thickness.

The invention therefore relates to a plasma panel in which at least one of the electrically insulating elements is made up from a polymerizable organic compound which is thermostable at a temperature equal to or less than the temperature of sealing of the panel.

The invention furthermore relates to a method for producing such electrically insulating elements.

The invention will be better understood, and the advantages which it provides will better emerge, on reading the description which follows, and is made by way of non-limiting example with reference to the single attached figure.

The attached figure, already partially described, schematically shows a plasma panel to which the invention may be applied.

In the example represented in the figure, the plasma panel 1 comprises two plates 2, 3 each carrying a network of electrodes X, Y1 to Yn, such that these electrodes are disposed on either side of the gaseous space 10 formed between the plates 2, 3. In this case, for an "alternating" panel, there must be at least one dielectric layer 4, 6 interposed between each network of electrodes and the gaseous space 10, i.e. at least two dielectric layers.

But there are other conventional forms of production (not represented), in which for example all the electrodes are disposed on the same side of the gaseous space 10, that is to say carried by the same plate; the latter is in this case generally the plate called the "back plate", that is to say the one which is opposite an observer and which generally comprises the exhaust tube (not represented) which makes it possible to establish the desired pressure in the panel (after the sealing step).

Whatever the form of production, and the number of dielectric layers such as the layers 4, 6, the invention proposes producing them from a thermostable polymerizable organic compound.

Thus for example the base organic compound may be a solution in an appropriate solvent (xylene or metacresol for example) of a dianhydride and of a diamine (whose formulas are given hereinbelow) in order to obtain a polyimide:

dianhydride: 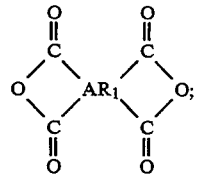

diamine: $NH_2—AR_2—NH_2$ polyimide: 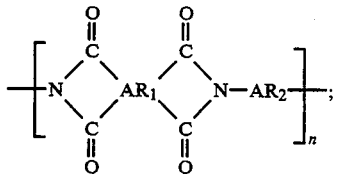

where $AR_1$ and $AR_2$ are aromatic chains.

The organic compound may be deposited by usual methods of depositing so-called "thick" films, for example the following methods: spinner, spraying, immersion, roller or silk-screen printing; in a manner which is in itself conventional, the viscosity of the product may be adapted to the method used by varying the polymer fraction in the solvent.

Heat is then progressively applied in order slowly to evaporate the solvents and to polymerize. The final temperature of polymerization should preferably be greater than or equal to the temperature of the step of sealing of the panel. For example, a layer with a final thickness of approximately 5 microns of polyphenylquinoxaline polymerized at 410° C. for 10 minutes will no longer develop chemically and mechanically during a sealing step at 400° C.

It will be recalled that the step of sealing a PP is the step in which the two plates 2, 3 are brought together in order to obtain the desired height H1 of the gaseous space 10, and in which the seals 11 are deformed in order to produce the leaktightness.

It is to be noted that the organic compound may be loaded with inorganic and/or metal compounds, with a view for example to modifying the dielectric constant and/or in order to change the color thereof.

The relative dielectric constant Er of the organic compounds used may be between 2 and 4 for the pure compound (for example a polyimide) and it may be increased in order to reach values greater than 10.

The thicknesses may vary from less than 1 micron to several tens of microns, according to the dielectric capacity sought by the layer.

For example, for the non-loaded organic compound ($2<Er<4$), correct operation of the "PP" is obtained for thicknesses e2 of the dielectric layers 4, 6, (after polymerization) of the order of 5 to 6 microns.

The possible color of the final deposition may also be adjusted by adding an organic colorant or an inorganic compound. Black or white deposits may also be obtained in this manner.

The thermally stable organic compound as defined above may be polymerized at relatively low temperatures, in order not to cause deformation of the glass substrate or plate 2, 3 or to degrade the other layers deposited on this substrate. In particular, the organic compound does not react with the material of the electrodes (ITO, metal, etc.).

Furthermore, the organic compound makes possible homogeneous covering of the electrodes and therefore withstands high electric fields without exhibiting any phenomenon of electrical breakdown.

The invention obviously applies just as well to the case when the dielectric layers are produced with continuous surfaces as in the case of discontinuous surfaces.

A polymerizable organic compound similar to that indicated hereinabove for the dielectric layers may constitute the base material for the production of the spacers and of the barriers 12, 15.

As above, the organic compound may be loaded with inorganic and/or metal compounds, in order to vary the viscosity and/or the color and/or the crushing strength thereof after polymerization.

The organic compound may be spread over the substrate or plate 2, 3 by usual methods similar to those cited furthest above for the dielectric layers (spinner, spraying, silk-screen printing, etc.).

Several layers may be necessary in order to obtain the desired height H2. In this case, a drying operation is interposed between each deposition step.

A significant advantage of the use of an organic compound for producing spacers results from the fact that this organic compound may be (or be rendered) photosensitive, and is therefore susceptible to being irradiated (through a mask) and etched. Such a material is called "photoimageable".

Photosensitive organic compounds are commercially available.

If several deposits are necessary in order to obtain the height H2, it is sufficient to irradiate the layer (generally by exposure to ultraviolet radiation) when the last deposition is performed, then to etch with the aid of conventional photoetching methods.

The irradiation and photoetching phase occurs after drying of the last deposit, and before polymerization or following a partial polymerization of the organic compound.

The organic compound is polymerized by exposing it to a thermal treatment and/or by irradiation with ultraviolet rays, in a manner which is in itself conventional.

The totality of the operations may be repeated in order to produce multilayer spacers or barriers.

The operations described hereinabove may be performed simultaneously for all the spacers which furthermore act as or do not act as a discharge barrier.

But these operations may also be repeated in particular in order to obtain a geometry and/or mechanical or optical properties which can vary in the thickness of the spacer which forms or does not forth a barrier. This is suggested in particular when it is desired to produce certain barriers with smaller heights, with a view to conditioning the cells (in particular circulation of the gas between the cells).

The photoimageable nature of the organic compound makes it possible to impart to the spacers and barriers 12, 15, in a simple and reliable manner, the desired dimensions as well as the desired positions in particular with respect to the electrodes X, Y1 to Yn.

This characteristic is particularly advantageous in the case of the barriers 15 whose width L, with respect to the pitch P of the cells, must remain relatively small, and whose position between the cells is also important.

Furthermore, spacers or barrier 12, 15 thus produced are thermostable and do not have a tendency to flow: it is therefore possible to obtain ratios of height H2 to length L (H1/L) greater than 1, for heights H2 greater than 200 microns.

The possibility of superimposing intermediate layers in order to obtain a final layer having the desired height H2 makes it possible to produce stacks in which at least one intermediate layer, the first produced for example, is colored (with a small thickness of the order of one to a few microns) with a view to increasing the optical contrast exhibited by the PP.

The invention may apply to the production of any electrically insulating element carried by a PP plate, whether the latter is of the continuous or alternating, monochrome or polychrome type, whatever the distribution of the electrodes with respect to the gaseous space, and whatever the number of electrodes used in order to define a cell.

I claim:

1. A plasma panel display device, comprising two plate (2,3) of which at least one carries electrodes (X, Y1 to Yn), the two plates (2,3) being assembled such that a space (10) is produced between these two plates, the space being intended to constitute a gaseous space whose leaktightness is produced by a sealing operation, having at least one dielectric layer (4,6) disposed between the gaseous space (10) and electrodes (X, Y1 to Yn), wherein the dielectric layer comprises an organic compound produced from at least one polymerizable organic compound.

2. A plasma display panel device according to claim 1, further having an electrically insulating element constituting a spacer (12, 15) and defining the height (H1) of the gaseous space (10), said spacer comprising an organic compound produced from at least one polymerizable organic compound.

3. A plasma display panel device according to claim 2, wherein the electrically insulating element constitutes a discharge barrier (15).

4. A plasma display panel device according to claim 1, wherein the organic compound of the dielectric layer is obtained from a mixture of monomers.

5. A plasma display panel device according to claim 1, wherein the organic compound of the dielectric layer is a polyimide.

6. A plasma display panel device according to claim 1, wherein the organic compound of the dielectric layer is thermostable up to a temperature at least equal to a temperature produced during the sealing operation.

7. A plasma display panel device according to claim 1, wherein the organic compound of the dielectric layer is photosensitive.

8. A plasma display panel device according to claim 1, wherein the polymerizable organic compound is polymerizable at a temperature less than or equal to a temperature causing a softening of at least one plate (2,3).

9. A plasma display panel device according to claim 1, wherein the organic compound of the dielectric layer is loaded with inorganic and/or metal products or compounds.

10. A method for producing a plasma panel display device according to claim 1, comprising a step of stabilizing the dielectric layer by irradiation with ultraviolet rays.

11. A method for producing a plasma panel display device according to claim 10, comprising a step of stabilizing the dielectric layer by exposing it to a temperature between the temperature produced during the sealing step and a softening temperature of at least one of the plates (2,3).

12. A plasma panel display device comprising two plates separated by a gaseous space, having seals disposed at the periphery of said plates, at least one of said plates containing electrodes and having a dielectric layer disposed thereon, wherein said dielectric layer comprises an organic polymer.

13. A plasma panel display device according to claim 12, wherein said dielectric layer comprises a polyimide.

14. A plasma panel display device according to claim 12, wherein said plates are separated by spacers which define the height of the gaseous space and which comprise an organic polymer.

15. A plasma panel display device according to claim 14, wherein said spacers constitute a discharge barrier.

16. A plasma panel display device according to claim 14, wherein said dielectric layer and said spacers comprise an organic compound that is photosensitive and thermostable up to a temperature at least equal to a temperature produced during the sealing operation.

17. A plasma panel display device according to claim 14, wherein said dielectric layer, or said spacers, or said dielectric layer and said spacers, are loaded with inorganic and/or metal products or compounds.

18. A plasma panel display device according to claim 12, wherein the dielectric layer is a continuous surface.

19. A plasma panel display device according to claim 12, wherein the dielectric layer is a discontinuous surface.

* * * * *